United States Patent [19]

Gray

[11] Patent Number: 4,695,249

[45] Date of Patent: Sep. 22, 1987

[54] FEED SYSTEM FOR PARTICLE DRYING PULSE JET COMBUSTORS

[76] Inventor: Robert R. Gray, 7110 Via Monte Mar Dr., Gladstone, Oreg. 97027

[21] Appl. No.: 783,859

[22] Filed: Oct. 3, 1985

[51] Int. Cl.[4] ..... F27B 15/00; F27D 7/00; F23C 11/04

[52] U.S. Cl. ..... 432/58; 431/1; 432/25

[58] Field of Search ..... 432/13, 25, 58; 431/1

[56] References Cited

U.S. PATENT DOCUMENTS 2,619,776 12/1952 Potters ..... 432/13
2,639,132 5/1953 Bradford ..... 432/13

*Primary Examiner*—John J. Camby

[57] ABSTRACT

Improved longitudinal axis feed system for the dehydration section of pulse jet combustion apparatus used for the drying of particulate materials.

4 Claims, 2 Drawing Figures

10
10'
12
14
16
18
20
22
24
26
28
30
32
34
36
40
42
44
46
48
50
52
54
56
58
60
62
64
66
68
70
72
74
76
78
84
116

FEED SYSTEM FOR PARTICLE DRYING PULSE JET COMBUSTORS

This invention relates to the drying of particulate material and more particularly to improved methods and apparatus for the pulse combustion drying of particulate material.

BACKGROUND OF THE INVENTION

Pulse combustion drying, employing a pulse combustor essentially similar in nature to a pulse jet engine, is a relatively recent but recognized technique for effecting the drying of particulate materials. Illustrative of some earlier endeavors in pulse jet field for drying and other purposes are U.S. Pat. Nos. 3,618,655; 4,226,668; 4,226,670; 4,265,617 and 2,838,869. In the first of these patents a plurality of pulse jet engines are mounted at the base of a vertical chamber. A paste or slurry of the particulate material to be dried is introduced into the exhaust duct of such pulse jet engines which function to at least partially dry the particulate material and introduce it into the chamber where induced vortex gas flow causes circulation of the particulate material and consequent opportunity for further drying thereof. In the latter of these patents a linear pulse jet engine assembly for projecting various types of materials is disclosed.

A current state of the art pulse combustion dryer is made and sold by Sonodyne Industries of Portland, Oregon. The pulse combustor unit, which is the heart of the drying system, is a specially contoured and generally U-shaped hollow tube whose dimensions and materials of construction determine its operation. The pulse combustion process is initiated when air and fuel from a constant low pressure supply thereof are drawn into the combustion chamber portion of the combustor and ignited by a spark. Hot gases created by the resulting detonation move in both directions from the combustion chamber. In one direction, they pass through an air inlet conduit and adjacent air augmenter, and in the other direction , through a U-shaped exhaust section and past a raw material injection port at the downstream end thereof. Detonation in the combustion chamber causes the pressure therein to rise, momentarily shutting off the fuel supply. As the combustion chamber pressure falls following detonation, fuel is again admitted and mixed with air being drawn through the inlet conduit. Detonation occurs again, either because of contact between the explosive air-fuel mixture and the spark or by contact with the sufficiently hot wall of the chamber itself. Once the wall temperature reaches approximately 1800° F., the spark can be extinguished and the process becomes self-igniting.

The pressure fluctuation, which causes the pulsing behavior of the combustor, results in strong standing waves of sound energy which move in both directions from the chamber. Repeated detonations also create high speed displacement of hot gases with about 70% thereof exiting through the tailpipe and associated exhaust system components. Introduction of moisture laden particulate material into the downstream end of the exhaust sections subjects such material to the sound waves which, although not fully understood, are believed to break the bonds between the solid particulate matter and the liquid, most often water, and in an atomization of the water into fine droplets with a consequent increase in surface area for evaporation. The heat present in the exhaust gas interacts with the atomized cloud of introduced raw material allowing highly efficient evaporation to occur. During drying, the rapid evaporation of the water absorbs most of the heat and the solid particulates are maintained and exit in a relatively cool state. It should be noted that while operating temperatures in the pulse combustion exhaust system exceed 2500 F., the residence time of the raw product solids in contact with the exhaust gases is very short, being in the order of a few milliseconds. Because of such short residence time and the high heat consumption effected by evaporation, the temperatures of the dried solid particulates rarely exceeds 100 to 150 F.

While pulse combustor drying apparatus of the type described immediately above has proved to be both efficient and economical in the drying of many diverse materials, certain problems have been encountered in the drying of particulate materials. One such problem has been a non-uniform water content in the dried material and another is the undesired accumulation and build up of dried or partially dried particulates at the downstream end of the drying cone. Such accumulation, which appears sporadically but builds up rapidly when it occurs, such as drilling mud, brewers yeast and certain resins.

SUMMARY OF THE INVENTION

This invention may be briefly described as an improved construction for pulse combustion drying apparatus and which includes, in the broad aspects, method and apparatus for effecting the introduction of the wet particulate material to be dried on the longitudinal axis of the dehydration cone to provide a uniform exposure of the material to the action of the high temperature exhaust gas. In its narrower aspects, the subject invention includes the provision of an eductor type feed to secure a concentric spray of feed stock into the exhaust gas flow essentially independent of the character of the feed stock.

The object of this invention is the provision of methods and apparatus for creating a concentric spray of feed stock into the exhaust gas stream on the longitudinal axis of the drying cone.

Another object of this invention is the provision of improved stock feeding means to obtain uniform exposure of the feed stock to both the sound energy and the elevated temperatures extant in the drying cone.

Other objects and advantages of the subject invention will be apparent from the following portions of this specification and from the appended drawings which illustrate, in accord with the mandate of the patent statutes, a presently preferred construction for a pulse combustor drying apparatus incorporating the principles of this invention.

Figure 1:
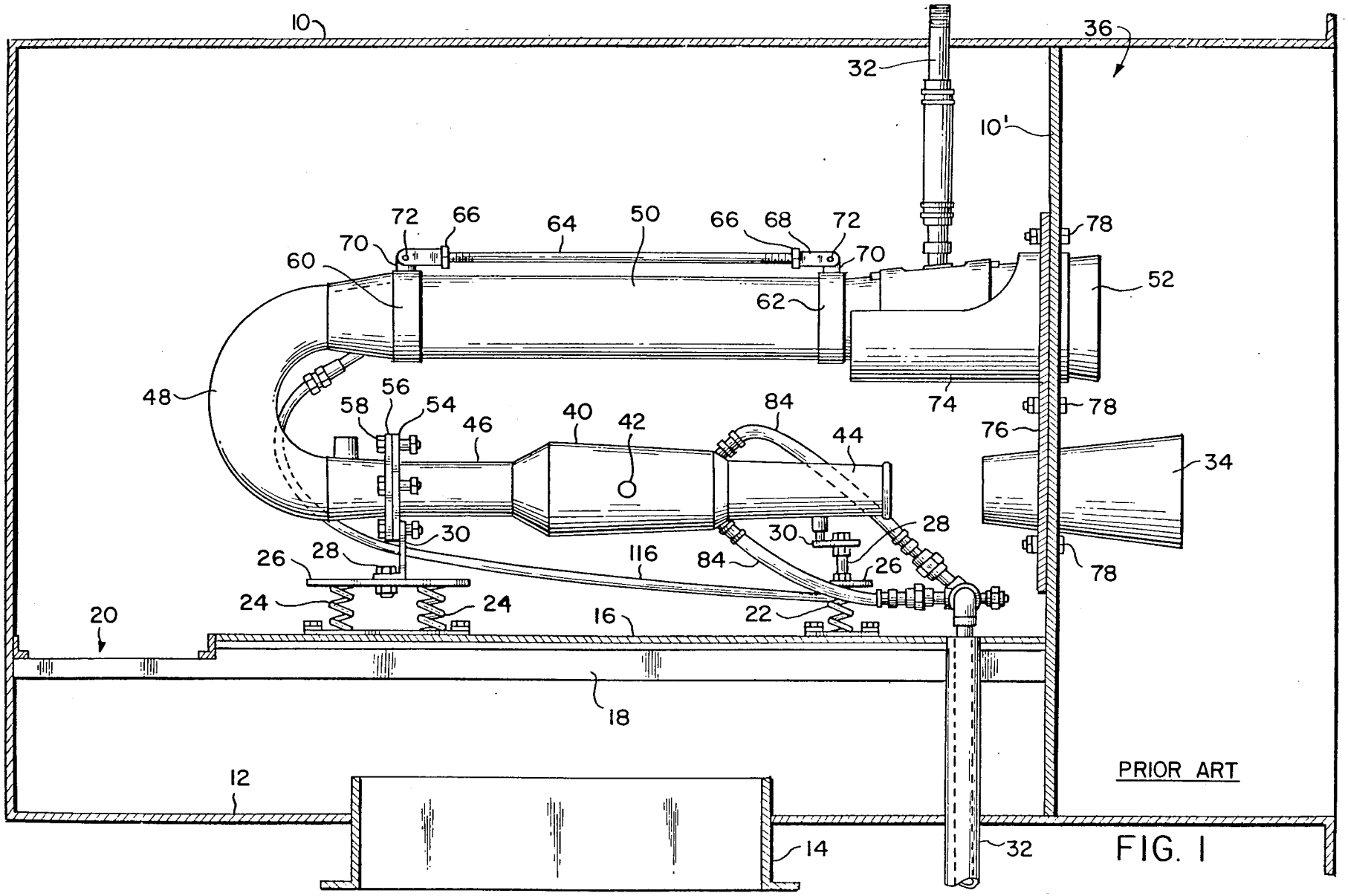
PRIOR ART FIG. 1
FIG. 1 is a schematic side elevaion of a pulse combustor drying system.

Referring intitially to FIG. 1, a conventional type of combustor drying system as there depicted broadly includes an isolating enclosure 10, desirably of double walled soundproof character, having an air inlet conduit 14 on the bottom wall 12 thereof. Disposed within the enclosure 10 is a platform 16 supported on beams 18 in uniform spaced relation to the enclosure bottom wall 12 and forming an inlet air plenum therebetween. The rearward end of the platform 16 terminates short of the rear wall of the enclosure 10 to provide an opening 20 for the passage of air upwardly from the air inlet conduit 14.

Also as illustrated, the pulse jet combustor is mounted in a resilient manner above the support platform 16 so as to cushion the platform and enclosure walls from vibrations incident to the operation of the combustor. Resilient mountings such as a front coil spring 22 and a rear pair of coil springs 24 extend upward from the platform 16, and suppport mounting plates 26 at their upper ends. Bolts 28 secured removably to the plates 26 serve to secure thereto brackets 30 which connect to and serve to support the front and rear portions of the combustor.

The pulse jet combustor includes a combustion chamber 40 of enlarged diameter provided with a spark plug 42 or other ignition means for igniting a combustible fuel-air mixture. Connected to the combustion chamber 40 is an air outlet conduit 44 which receives atmospheric air from within the enclosure 10, and a combustion gas outlet conduit generally shown as 46.

The combustion gas outlet conduit 46 communicates through an arcutate and generally U-shaped coupling section 48 with a tailpipe 50 which, in turn, communicates at its downstream or exhaust outlet end with a materials dehydration section 52.

In the illustrated embodiment, the combustion gas outlet conduit 46 of the combustion chamber section 40 is provided at its downstream or outlet end with a peripheral flange 54 arranged for removable connection to a corresponding flange 56 at the adjacent upstream or inlet end of the U-shaped coupling or transition section 48, as by means of a plurality of bolts 58. The downstream end of the coupling section 48 is fitted with an outer, forwardly projecting annular collar 60 dimensioned to freely receive therein the adjacent upstream end of the tailpipe section 50.

The downstream end of the tailpipe section 50 is, in similar manner, freely received within an enlarged collar 62 secured to and extending rearwardly of the upstream end of a dehydration section 52 in the form of a hollow truncated cone and generally called a "drying cone" . To facilitate tailpipe replacement the collars 60 and 62 are interconnected by a turnbuckle assembly which includes an enlarged threaded rod 64 received at its opposite ends in threaded nuts 66. Each nut is secured to a pair of laterally spaced lugs 68 which receive between them an ear 70 extending upwardly from the associated collar. Registering openings in the lugs and ears receive a pivot pin 72 for joining them together.

The dehydration section 52, which is of elongated frusto-conical shape and will be hereinafter identified as a dehydration or drying cone, extends through and is supported by a mounting plate 76. The mounting plate 76 is secured removably to a wall 10' of the enclosure, as by bolts 78. As is apparent, the dehydration cone 52 terminates within an adjacent large volume collector room 36 wherein the majority of the dried particulates settle out and are collected in any suitable manner. A duct collector or other conventional particulate collecting device is usually connected to the gas exhaust system for such collecting chamber or room 36 to effect recovery of substantially all of the dried particulates.

A wet product inlet conduit 32 is connected to the dehydration cone 52 for introduction of the wet product feed stock into the cone in a direction substantially perpendicular to the direction of movement of the high velocity gases of combustion passing through the tailpipe and exiting from the downstream end of the dehydration cone 52.

Combustible fuel, such as oil, gas, etc. is delivered to the combustion chamber 40 by one or more fuel supply lines, such as the two lines 84 illustrated, connected to the fuel inlet conduit 32.

The plate 76 supporting the dehydration cone also supports a so called "augmenter" in the form of a hollow truncated cone 34 disposed in spaced axial alignment with the air inlet portion 44 of the combustion chamber 40 and which also extends through the forward engine room wall 10'. In the described system, the augmenter 34 functions to direct the high velocity combustion gases emittted as back flow from the combustion chamber 40 and air inlet conduit 44 into the adjacent collector room 36.

In the operation of the above described pulse combustor system, the combustor is activated by delivery of combustible fuel and air to the combustion chamber 40 where is is ignited by a spark from the plug 42. A wet product in the form of a slurry, paste or moist particulates is fed, generally under pressure, through the material inlet conduit 32 from whence it enters the dehydration cone 52 in a direction substantially perpendicular to the direction of flow of high velocity combustion gases through the dehydration cone 52.

While, as noted earlier, operation of pulse combustor drying apparatus of the type described above has proved to be both efficient and economical in the drying of many diverse materials, occasional problems of non-uniform drying and of partially dried material "sticking" to the drying cone surface with a concomitant rapid build up thereof and degradation of combustor operation, has been encountered with certain materials. Such "sticking" and material build up always appears to occur in the "low velocity" area at the exit end of the dehydration cone 52.

Figure 2:
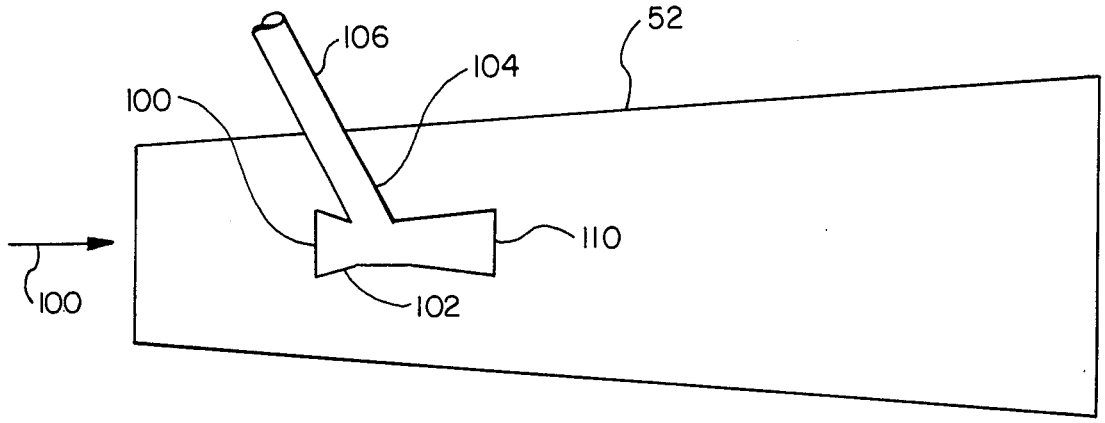
FIG. 2 is an enlarged vertical section of an improved construction for introduction of feed stock into a dehydration cone that incorporates the principles of this invention.

Referring now to FIG. 2, there is depicted, in schematic form, the essentials of an improved wet stock feed device adapted to deliver a concentric uniform spray of the feed stock on the longitudinal axis of the drying cone 52 into the exhaust gas stream. As shown, the drying cone 52 is of frusto-conical configuration and is of increasig diameter in the direction of exhaust gas flow, as illustrated by the arrow 100.

Disposed at the entry end of the drying cone 52 and concentrically positioned about the longitudinal axis thereof is an open-ended tube 102. Connected thereto, as at 104, is a feed stock delivery tube 106, through which the feed stock, in the form of a slurry, a paste or mere wet particulates is delivered, under sufficient pressure to effect introduction thereof, at a controlled rate into tube 102.

As will now be apparent, a portion of the high temperature exhaust gas stream will enter the upstream end 108 of the tube 102 and, in passage therethrough will entrain, through eductor action and velocity pressures, the feed stock being delivered through the delivery tube 106 and effect its emission in the form of a spray from the downstrem end 110 thereof concentric with the longitudinal axis of the cone 52. Such emitted spray will then be subject to the sonic energy and main exhaust gas stream for conventional pulse combustor drying phenomena.

While a straight tube 102 may be employed, other configurations such as a converging entry end and diverging exit end and other venturi shaped variants may also be employed dependent, at least in part, upon the character of a particular feed stock.

The introduction of the feed stock in the form of a concentric spray on the longitudinal axis of the drying cone effects an enhancement of the uniformity of the drying process and additionally contributes to the reduction of detrimental sticking of the particulate material at the downstream end of the drying cone.

I claim:

1. In pulse jet combustor apparatus for the drying of particulate material of the type having a combustion chamber, an air inlet conduit connected to one end thereof, a primary exhaust gas outlet conduit connected to the other end thereof, an elongated transition-tailpipe section connected to said primary exhaust conduit, and a frusto-conically shaped drying section of increasing diameter having its upstream end connected to the downstream end of said transition-tailpipe section and having means for introducing a feed stock of particulate material to be dried therein, the improvement wherein said last mentioned means comprises an open-ended tube disposed in spaced relation with the surrounding wall of the upstream end of said frusto-conically shaped drying section and in concentric relation with the longitudinal axis thereof, a feed stock delivery tube connected to said open-ended tube intermediate the ends thereof for introducing said feed stock into the path of exhaust gas passing through said tube.

2. The improved pulse jet combustor apparatus as set forth in claim 1 wherein the end of said open-ended tube facing the oncoming exhaust gas stream is of converging configuration.

3. The improved pulse jet combustor apparatus as set forth in claim 1 wherein the end of said open-ended tube downstream of the locus of feed stock introduction therein is of diverging configuration.

4. The improved pulse jet combustor apparatus as set forth in claim 1 wherein said open-ended tube is of venturi configuration.

* * * * *